US009702193B2

(12) United States Patent
Winslow

(10) Patent No.: US 9,702,193 B2
(45) Date of Patent: Jul. 11, 2017

(54) APPARATUS AND METHOD FOR ROTARY STEERING

(75) Inventor: Daniel Winslow, Spring, TX (US)

(73) Assignee: HALLIBURTON ENERGY SERVICES, INC., Houston, TX (US)

( * ) Notice: Subject to any disclaimer, the term of this patent is extended or adjusted under 35 U.S.C. 154(b) by 598 days.

(21) Appl. No.: 14/008,680

(22) PCT Filed: Mar. 30, 2011

(86) PCT No.: PCT/US2011/030508
§ 371 (c)(1),
(2), (4) Date: May 8, 2014

(87) PCT Pub. No.: WO2012/134461
PCT Pub. Date: Oct. 4, 2012

(65) Prior Publication Data
US 2014/0231136 A1 Aug. 21, 2014

(51) Int. Cl.
*E21B 44/00* (2006.01)
*E21B 7/06* (2006.01)

(52) U.S. Cl.
CPC ..... *E21B 7/06* (2013.01); *E21B 7/062* (2013.01); *E21B 44/00* (2013.01)

(58) Field of Classification Search
USPC ..... 175/61, 24, 74, 40
See application file for complete search history.

(56) References Cited

U.S. PATENT DOCUMENTS 5,316,090 A * 5/1994 Kuwana ..... E21B 7/062 175/61
6,213,226 B1 4/2001 Eppink et al.
6,234,259 B1 * 5/2001 Kuckes ..... E21B 7/062 175/61
6,892,830 B2 * 5/2005 Noe ..... E21B 7/062 175/61
2001/0052427 A1 * 12/2001 Eppink ..... E21B 4/006 175/40
2002/0195249 A1 * 12/2002 Murray ..... E21B 29/06 166/313
2004/0084219 A1 5/2004 Moore et al.
2005/0247489 A1 * 11/2005 Jamieson ..... E21B 7/062 175/263
2005/0269082 A1 * 12/2005 Baron ..... E21B 47/022 166/255.2
2006/0157281 A1 * 7/2006 Downton ..... E21B 7/06 175/61
2010/0236830 A1 9/2010 Haughom

FOREIGN PATENT DOCUMENTS

EP 1607571 A2 12/2005

OTHER PUBLICATIONS

PCT International Search Report; PCT/US2011/030508; 5 sheets; Filing Date Mar. 30, 2011.

* cited by examiner

*Primary Examiner* — Taras P Bemko

(57) ABSTRACT

A method and system for steering a rotary steerable tool in a borehole. A method includes rotating a deflection sleeve about a steerable shaft. A deflection ramp is aligned to deflect the shaft in a predetermined direction by the rotating. The deflection sleeve is axially displaced along the steerable shaft. The steerable shaft is deflected by the displacing.

21 Claims, 5 Drawing Sheets

APPARATUS AND METHOD FOR ROTARY STEERING

BACKGROUND

Directional borehole operations, such as directional drilling, involve varying or controlling the direction of a downhole tool (e.g., a drill bit) in a wellbore to direct the tool towards a desired target destination. In directional drilling, for example, the direction of a drill bit is controlled to direct the bit, and the resultant wellbore, towards a desired target destination.

Various techniques have been used for adjusting the direction of a tool string in a borehole. Slide drilling employs a downhole motor and a bent housing to deflect the borehole. In slide drilling, the direction of the borehole is changed by using the downhole motor to rotate the bit while drill string rotation is halted and the bent housing is oriented to deflect the bit in the desired direction. Slide drilling systems are subject to various problems related to halting drill string rotation. For example, a non-rotating drill string is subject to sticking in the wellbore.

In contrast to slide drilling systems, rotary steerable systems allow the entire drill string to rotate while changing the direction of the borehole. By maintaining drill string rotation, rotary steerable systems overcome various deficiencies of slide drilling. A tool for controlling deflection in a rotary steerable system (i.e. a rotary steerable tool) generally includes a shaft that rotates with the drill string, and a housing surrounding the shaft that includes a device that applies a deflection force to the shaft. By deflecting the shaft, the direction of the downhole end of the shaft is changed.

BRIEF DESCRIPTION OF THE DRAWINGS

In the following detailed description of exemplary embodiments of the invention, reference will be made to the accompanying drawings, in which.

NOTATION AND NOMENCLATURE

Certain terms are used throughout the following description and claims to refer to particular system components. As one skilled in the art will appreciate, companies may refer to a component by different names. This document does not intend to distinguish between components that differ in name but not function. In the following discussion and in the claims, the terms "including" and "comprising" are used in an open-ended fashion, and thus should be interpreted to mean "including, but not limited to . . . ." Also, the term "couple" or "couples" is intended to mean either an indirect or direct connection. Thus, if a first device couples to a second device, that connection may be through a direct connection, or through an indirect connection via other devices and connections.

DETAILED DESCRIPTION

The following discussion is directed to various embodiments of the invention. The embodiments disclosed should not be interpreted, or otherwise construed, as limiting the scope of the disclosure, including the claims. In addition, one skilled in the art will understand that the following description has broad application, and the discussion of any embodiment is meant only to be exemplary of that embodiment, and not intended to intimate that the scope of the disclosure, including the claims, is limited to that embodiment.

In order to properly steer the shaft of a rotary steerable tool, a deflection mechanism within the tool must be positioned to deflect the shaft in a desired direction. Some rotary steerable tools include a plurality of actuators each oriented to deflect the steerable shaft in a different direction, thereby allowing the shaft to be deflected in any desired direction by operation of the appropriate actuators. Embodiments of the present disclosure include a single deflection sleeve that rotates within the tool to position a ramped surface to deflect the steerable shaft in a desired direction. Longitudinal movement of the deflection sleeve relative to the rotary steerable tool applies deflection force to the steerable shaft.

Figure 1:
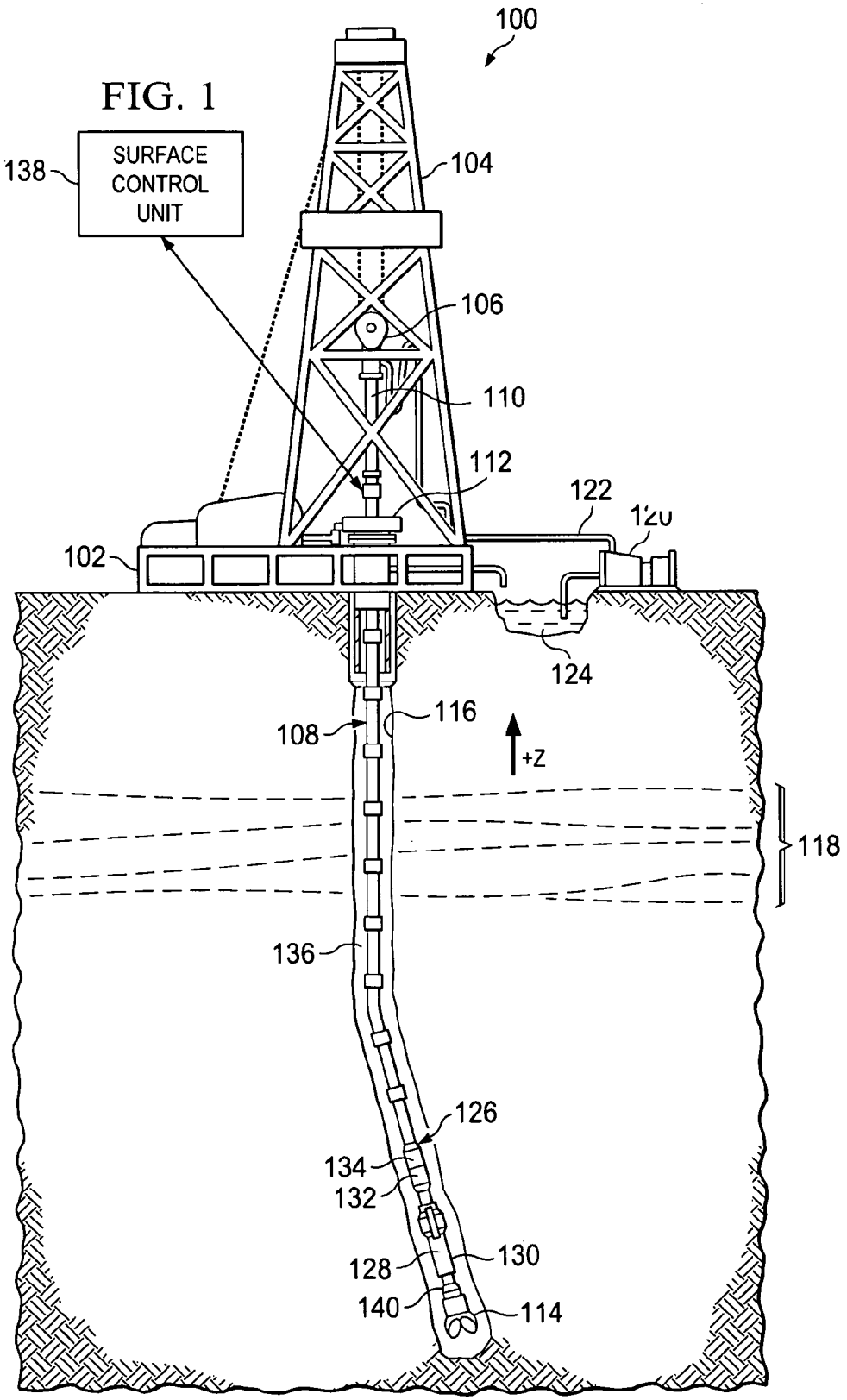
FIG. 1 shows a downhole tool string including a rotary steerable tool in accordance with various embodiments.

FIG. 1 shows a tool string 126 disposed in a directional borehole 116. The tool string 126 including a rotary steerable tool 128 in accordance with various embodiments. A drilling platform 102 supports a derrick 104 having a traveling block 106 for raising and lowering a drill string 108. A kelly 110 supports the drill string 108 as it is lowered through a rotary table 112. In some embodiments, a topdrive is used to rotate the drill string 108 in place of the kelly 110 and the rotary table 112. A drill bit 114 is positioned at the downhole end of the tool string 126, and is driven by a downhole motor (not shown) positioned in the tool string uphole of the rotary steering tool 128 and/or rotation of the drill string 108 from the surface. As the bit 114 rotates, it creates the borehole 116 that passes through various formations 118. A pump 120 circulates drilling fluid through a feed pipe 122 and downhole through the interior of drill string 108, through orifices in drill bit 114, back to the surface via the annulus 136 around drill string 108, and into a retention pit 124. The drilling fluid transports cuttings from the borehole 116 into the pit 124 and aids in maintaining the integrity of the borehole 116.

The tool string 126 may include one or more logging-while-drilling ("LWD")/measurement-while-drilling ("MWD") tools 132 that collect measurements relating to various formation properties as well as the position of the bit 114 and various other drilling conditions as the bit 114 extends the borehole 108 through the formations 118. The MWD tool 132 may include a device for measuring formation resistivity, a gamma ray device for measuring formation gamma ray intensity, devices for measuring the inclination and azimuth of the tool string 126, pressure sensors for measuring drilling fluid pressure, temperature sensors for measuring borehole temperature, etc.

The tool string 126 may also include a telemetry module 134. The telemetry module 134 receives data provided by the various sensors of the tool string 126 (e.g., sensors of the MWD tool 132), and transmits the data to a surface control unit 138. Similarly, data provided by the surface control unit 138 is received by the telemetry module 134 and transmitted to the tools (e.g, MWD tool 132, rotary steering tool 128, etc.) of the tool string 126. In some embodiments, mud pulse telemetry, wired drill pipe, acoustic telemetry, or other telemetry technologies know in the art may be used to provide communication between the surface control unit 138 and the telemetry module 134.

The rotary steerable tool 128 is configured to change the direction of the tool string 126 based on information indicative of tool 128 orientation and a desired direction of the tool string 126. The rotary steerable tool 128 includes a rotation resistant housing 130 disposed about a steerable shaft 140. The steerable shaft 140 transfers rotation through the rotary steerable tool 128. A deflection sleeve surrounding the shaft 140 is rotatable within the rotation resistant housing 130 to orient the sleeve such that the shaft 140 can be deflected by axial movement of the sleeve. Some embodiments of the rotary steerable tool 128 include a direction sensor (e.g., a magnetometer, gyroscope, accelerometer, etc.) for determining an azimuth to a reference direction (e.g., magnetic north), and based on the azimuth and a desired direction, the rotary steerable tool 128 determines a suitable orientation of the deflection sleeve to steer the tool string 126 in the desired direction.

Figure 2A:
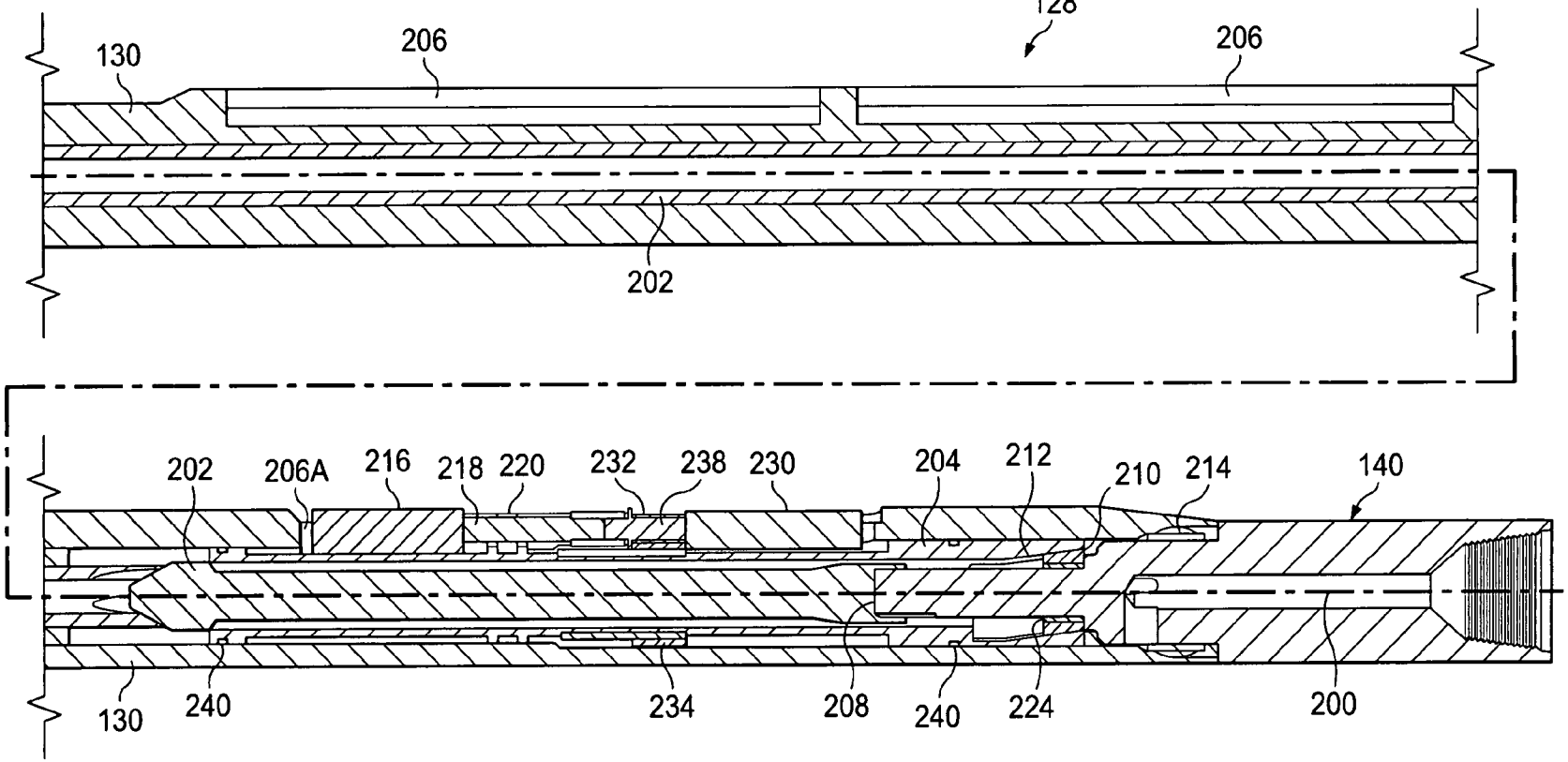
FIGS. 2A and 2B show axial cross-sections of a rotary steerable tool in accordance with various embodiments.

FIG. 2A shows an axial cross-section of a rotary steerable tool 128 in accordance with various embodiments. The rotary steerable tool 128 includes the rotation resistant housing 130, an input shaft 202, a deflection sleeve 204, and the steerable shaft 140. The rotation resistant housing 130 may include one or more pockets 206 for holding sensors, control electronics, measurement electronics, telemetry electronics, batteries, hydraulics, etc. for use with the rotary steerable tool 128. In some embodiments, the pockets 206 may be formed in the exterior of the housing 130 as shown in FIG. 2A. In other embodiments, the pockets 206 are formed in an interior surface of the housing 130. Seals 240 seal the pocket 206A and prevent drilling fluid and other downhole substances from entering the pocket 206A between the housing 130 and the deflection sleeve 204. Pocket 206A may be filled with a lubricant and seals 240 prevent drilling fluid from mixing with the lubricant. Each of the pockets 206 may be sealed with seals 240, sealed with a cover, and/or a pressure housing may be placed in the pocket 206.

The input shaft 202 is coupled to a component of the drill string 108 uphole of the rotary steerable tool 128, and is rotated by a downhole motor output shaft or other rotation of the drill string 108 (e.g., rotation induced at the surface by a top drive or rotary table). In some embodiments, the input shaft 202 is coupled to a constant velocity (CV) joint 208 within the rotary steerable tool 128. The CV joint 208 couples the input shaft 202 to the steerable shaft 140. In some embodiments, the steerable shaft 140 comprises the input shaft 202. That is, in such embodiments, the input shaft 202 is integral to the steerable shaft 140. The steerable shaft 140 includes an inclined surface (a shaft ramp) 210. The shaft ramp 210 engages the deflection sleeve 204 to change the direction of the steerable shaft 140.

The deflection sleeve 204 is disposed about the steerable shaft 140, and may be disposed about at least a portion of the input shaft 202. The deflection sleeve 204 includes an inclined surface (an angled deflection ramp) 212. Axial movement of the deflection sleeve 204 causes the deflection ramp 212 to slideably contact the shaft ramp 210 causing the shaft ramp 210 to pivot about a pivot bearing 214. Rotational movement of the deflection sleeve 204 orients the deflection ramp 212 to deflect the steerable shaft 140 in a desired direction for drilling or other purposes. Thus, axial motion of the deflection sleeve 204 causes a controllable deviation of the bit direction with respect to a longitudinal axis 200 of rotary steerable tool 128 and generates a controllable build angle during drilling of the formation 118. Rotation of deflection sleeve 204 positions the angled deflection ramp 212 to a desired rotational position about axis 200. By combining axial and rotational motions, embodiments of the rotary steerable tool 128 provided a controlled build angle and drilling direction for downhole steering.

Some embodiments of the rotation resistant housing 130 include members (not shown) that extend to contact a wall of the borehole 116. Such members control rotation housing 130 relative to the borehole to maintain controlled direction of the rotary steerable tool 128 during operation.

Figure 2B:
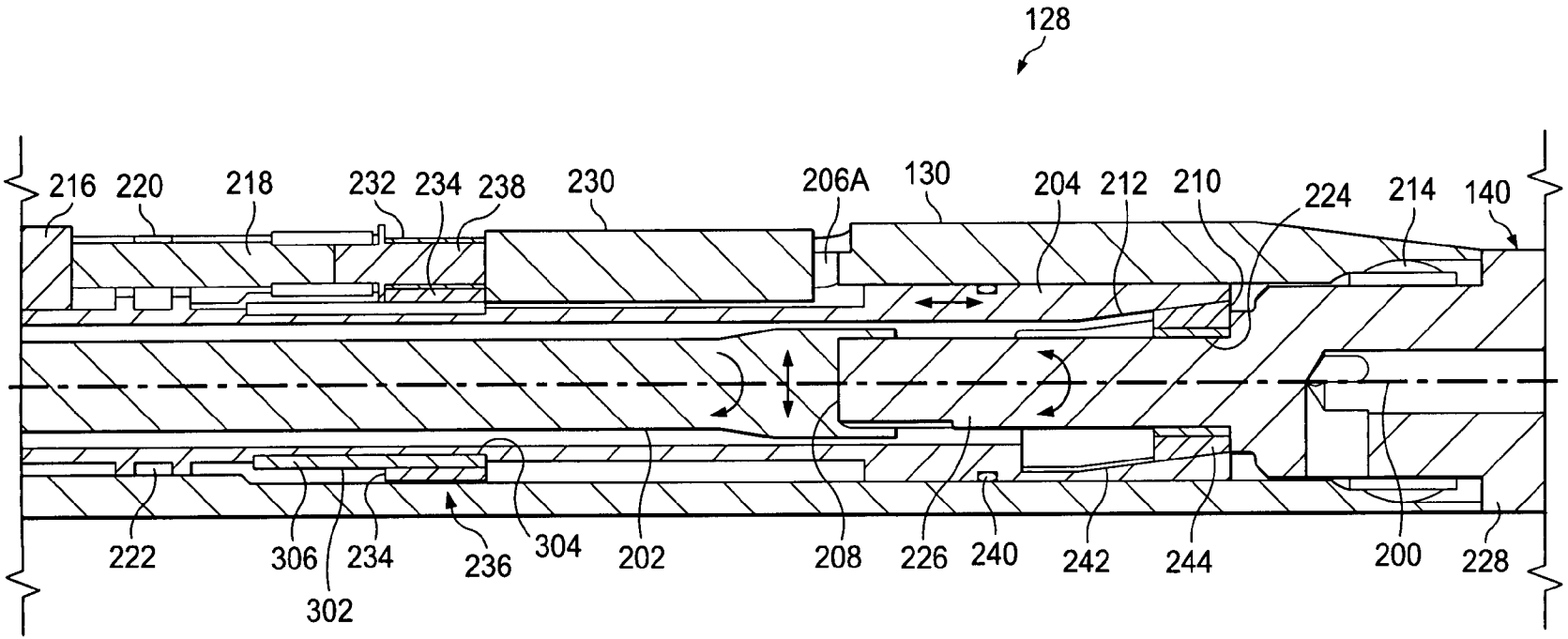

FIG. 2B shows an enlarged axial cross-section of a portion of the rotary steerable tool 128. As mentioned above, devices for controlling the operation of the rotary steerable tool 128 may be located in the pockets 206 (e.g., the pocket 206A). Such devices include mechanisms for controlling axial and rotational movement of the deflection sleeve 204. A mechanism for controlling axial movement of the deflection sleeve 204 includes an axial drive motor 216, an axial extension shaft 218, and an axial motion coupling 220. The axial extension shaft 218 may include a ball screw mechanism or a threaded shaft and power nut type mechanism. The axial motion coupling 220 fits in a groove 222 of the deflection sleeve 204. The axial drive motor 216 turns the axial extension shaft 218 causing the axial motion coupling 220, and correspondingly the deflection sleeve 204, to move longitudinally within the housing 128.

The shaft ramp 210 is rotationally coupled to the steerable shaft 140 by a bearing 224. In some embodiments, the steerable shaft 140 may include a mandrel shaft 226 integral to an output mandrel 228. In other embodiments, the mandrel shaft 226 and the output mandrel 228 may be separate parts that are mechanically joined using suitable mechanical joining techniques known in the art.

A mechanism for controlling rotational movement of the deflection sleeve 204 includes a rotational drive motor 230, a pinion gear 232, a drive gear 234, and a spline 236. The pinion gear 232 is coupled to a rotational output shaft 238 of the rotational drive motor 230. The pinion gear 232 engages and transfers rotation to the drive gear 234. The drive gear 234 is circumferentially disposed about the deflection sleeve 204. The spline 236 slideably couples the drive gear 234 to the deflection sleeve 204. Thus, rotation of the pinion gear 232 by the rotational drive motor 230 rotates the deflection sleeve 204 about the steerable shaft 140, and the spline 236 allows for axial movement of the deflection sleeve 204.

Figure 3A:
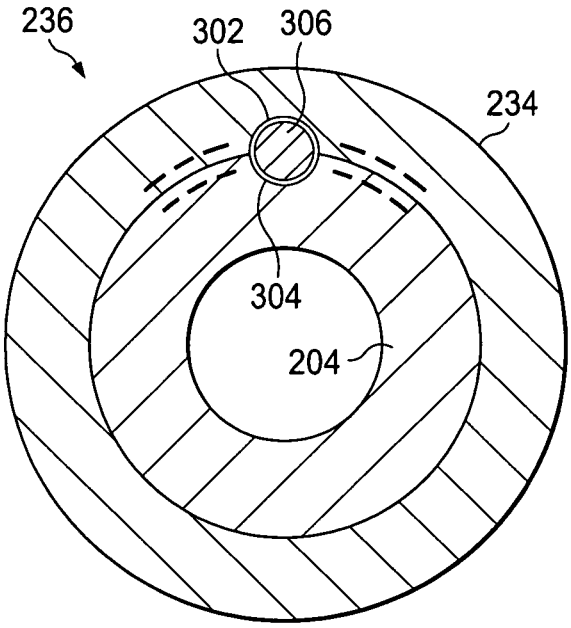
FIGS. 3A and 3B show cross-sectional views of a spline coupling a deflection sleeve and drive gear in accordance with various embodiments.

FIG. 3A shows a cross-sectional view of the spline 236 coupling the deflection sleeve 204 and the drive gear 234 (as shown at 236 of FIG. 2A) in accordance with various embodiments. The spline 236 comprises at least one internal longitudinal groove 302 formed on the inner diameter surface of the drive gear 234, at least one similarly sized external longitudinal groove 304 located on an outer diameter surface of deflection sleeve 204, and at least one spline pin 306 sized to fit between the aligned grooves 302 and 304. Activation of rotational drive motor 230 imparts rotational motion to deflection sleeve 204 via the spline 236. Any suitable number of splines 236 may be located around the circumferences of deflection sleeve 204 and drive gear 234.

Figure 3B:
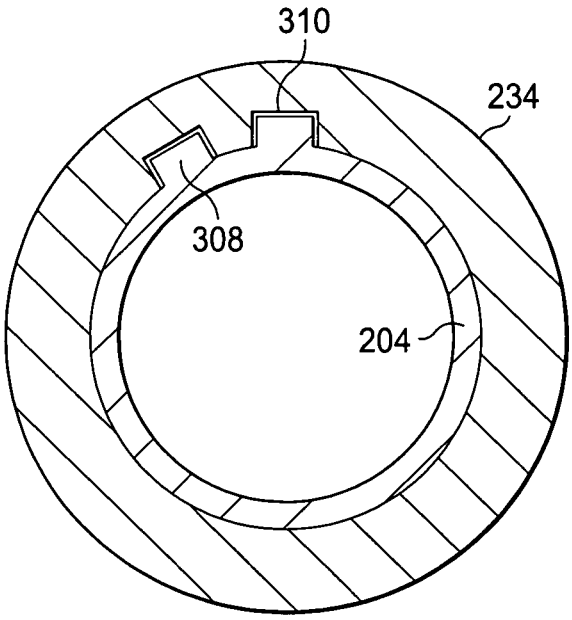

FIG. 3B shows a cross-sectional view of an alternate spline embodiment coupling the deflection sleeve 204 and the drive gear 234. In this embodiment, the deflection sleeve 204 includes external longitudinal projections 308, and the drive gear 234 includes internal longitudinal grooves 310. The internal grooves 310 engage the external projections 308 and transfer rotational motion of the motor shaft 238 to the deflection sleeve 204. Any suitable number of projections 308 and grooves 310 may be located around the circumferences of the deflection sleeve 204 and the drive gear 234.

Referring again to FIG. 2B, the deflection sleeve 204 includes a second deflection ramp 242 opposite the deflection ramp 212, and the steerable shaft 140 includes a second shaft ramp 244 opposite the shaft ramp 210. The ramps 242 and 244 engage as the deflection sleeve 204 is axially withdrawn towards the uphole end of the rotary steerable tool 128 to center the steerable shaft 140 when a direction change is completed.

Figure 4:
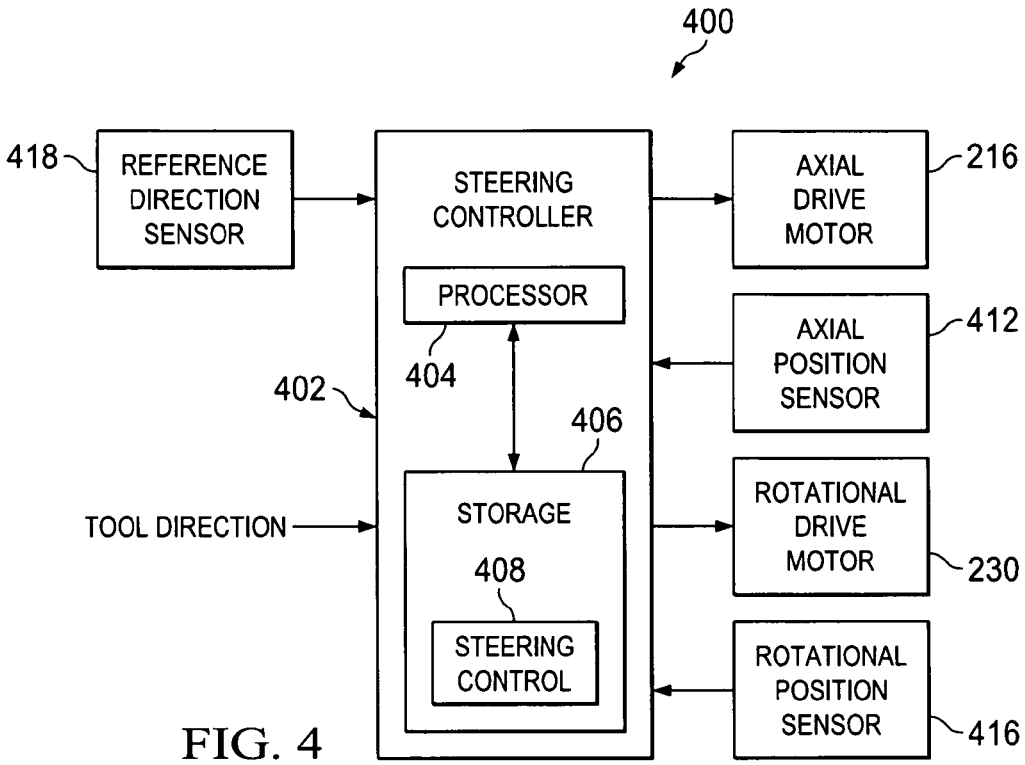
FIG. 4 shows block diagram of control system for a rotary steerable tool in accordance with various embodiments.

FIG. 4 shows a block diagram of control system 400 for a rotary steerable tool 128 in accordance with various embodiments The control system 400 includes a steering controller 402, the axial drive motor 410, the rotational drive motor 414, and a reference direction sensor 418. The reference direction sensor 418 provides information to the steering controller 402 indicative of an angular offset from a reference direction to a reference location (e.g., a reference location of the rotation resistant housing 130) of the rotary steerable tool 128. The reference direction sensor 418 may include gravity sensors, magnetic sensors, etc. Some embodiments of the control system 400 also include an axial position sensor 412 and/or a rotational position sensor 416 that provide information indicative of axial and/or radial position of the deflection sleeve 204.

The steering controller 402 determines a rotational position of the deflection sleeve 204 relative to the desired tool direction (e.g., an azimuth from a reference point of the rotary steerable tool 128 to the deflection ramp 212 and from the reference point to the desired tool direction). The steering controller 402 enables the rotational drive motor 230 to rotate the deflection sleeve 204 to a point where the defection ramp 212 is positioned to deflect the steerable shaft 140 in the desired tool direction (e.g., the deflection ramp 212 may be positioned towards the desired direction). The steering controller 402 may control the rotational drive motor 230 by controlling the flow of electrical power to the motor 230 or by manipulating electrical signals that control the operation of the motor 230 (e.g., signals that control the speed and/or direction of motor rotation). The rotational position sensor 416 may provide information indicative of the rotational position of the deflection sleeve 204, and the steering controller 402 may base determinations of deflection sleeve rotational position on information provided by the rotational position sensor 416.

The steering controller 402 also controls the axial position of the deflection sleeve 204. The steering controller 402 determines an amount of deflection to apply to the steerable shaft 140 based, for example, on a time or distance over which the rotary steerable tool 128 is to be turned to a desired direction. Based on the determined amount of deflection, the steering controller 402 determines an axial position to which the deflection sleeve 204 is to be moved, and enables the axial drive motor 216 to move the deflection sleeve 204 to the determined axial position. The steering controller 402 may control the axial drive motor 216 by controlling the flow of electrical power to the motor 216 or by manipulating electrical signals that control the operation of the motor 216 (e.g., signals that control the speed and/or direction of motor rotation). The axial position sensor 412 may provide information indicative of the axial position of the deflection sleeve 204, and the steering controller 402 may base determinations of deflection sleeve axial position on information provided by the axial position sensor 412.

The steering controller 402 includes a processor 404 and storage 406. The processor 402 may be any processor suitable for determining and controlling the axial and rotational positions of the deflection sleeve 204. Appropriate processors include, for example, general-purpose processors, digital signal processors, and microcontrollers suitable for use in a downhole environment. Processor architectures generally include execution units (e.g., fixed point, floating point, integer, etc.), storage (e.g., registers, memory, etc.), instruction decoding, peripherals (e.g., interrupt controllers, timers, direct memory access controllers, etc.), input/output systems (e.g., serial ports, parallel ports, etc.) and various other components and sub-systems.

The storage 406 includes a computer readable storage medium for storing software programming executable by the processor 404. In particular, the steering control module 408 includes software instructions that when executed cause the processor 404 to determine and control the rotational and axial positions of the deflection sleeve 204 as described herein. A computer readable storage medium comprises volatile storage such as random access memory, non-volatile storage (e.g., a hard drive, an optical storage device (e.g., CD or DVD), FLASH storage, or combinations thereof.

In some embodiments, portions of the steering control system 400 can be implemented using dedicated circuitry (e.g., dedicated circuitry implemented in an integrated circuit). Some embodiments may use a combination of dedicated circuitry and software executed by a processor. Selection of a hardware or software/processor implementation of embodiments is a design choice based on a variety of factors, such as cost, time to implement, and the ability to incorporate changed or additional functionality in the future.

Furthermore, portions of the steering control system 400 may be provided at various locations in the system 100 (FIG. 1). Some embodiments may provide the steering control system 400 wholly within the rotary steerable tool 128. Other embodiments may provide portions of the steering control system 400 in the surface control unit 138 or another portion of the drill string 108.

Figure 5:
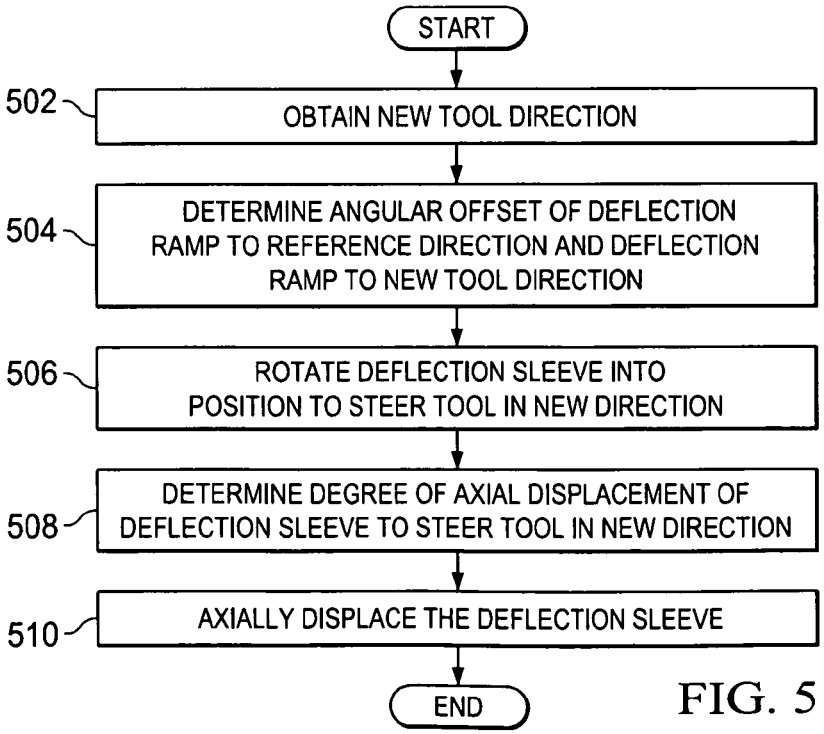
FIG. 5 shows a flow diagram for a method for steering a rotary steerable tool in accordance with various embodiments.

FIG. 5 shows a flow diagram for a method for steering a rotary steerable tool 128 in accordance with various embodiments. Though depicted sequentially as a matter of convenience, at least some of the actions shown can be performed in a different order and/or performed in parallel. Additionally, some embodiments may perform only some of the actions shown. In some embodiments, at least some of the operations of FIG. 5, as well as other operations described herein, can be implemented by the rotary steerable tool 128, and/or the steering control system 400 as instructions stored in a computer readable medium and executed by the processor 402.

In block 502, the tool string 126 is rotating in the borehole 116. The tool string 126 may be rotated by a downhole motor or from the surface by a top drive or rotating table. The steering control system 400 obtains direction information indicating that the tool string 126 is to be steered in a new direction. The direction information may be retrieved from storage accessible by the steering control system 400 or transmitted to the steering control system 400 from another location (e.g., from the surface control unit 138).

In block 504, the steering control system 400 determines the angular offset between a reference direction and a reference location of the rotary steerable tool 128. The angular offset may be provided by based on information provided by the reference direction sensor 418. Based on the determined angular offset, the steering control system 400 determines an azimuth between the deflection ramp and the new direction, and based on the azimuth determines how far the deflection sleeve 204 should be rotated to position the deflection ramp 212 to steer the tool string 126 in the new direction.

In block 506, the steering control system 400, activates the rotational drive motor 230 and by operation of the motor 230 rotates the deflection sleeve 204 to the position determined for effectuation of the new direction. The motor 230 rotates the pinion gear 232, which in turn rotates the drive gear 234 that is coupled by splines to the deflection sleeve 204. In some embodiments, the deflection sleeve 204 may be rotated to a position where the deflection ramp 212 is positioned towards a portion of the rotary steerable tool 128 facing the new direction.

In block 508, the steering control system 400 determines a degree of deflection to be applied to the steerable shaft 140. The degree of deflection may be based, for example, on a time or distance of travel over which tool string 126 is move to the new direction. Based on the determined degree of deflection, the steering control system 400 determines an amount of axial displacement to apply to the deflection sleeve 204.

In block 510, the steering control system 400 activates the axial drive motor 216 and by operation of the motor 216 deflects the steerable shaft 140 in the new direction. The motor 216 rotates the axial extension shaft 218 causing the axial motion coupling 220 to move longitudinally along the shaft 218. The axial motion coupling 220 is set in the groove 220 of the deflection sleeve 204 causing the deflection sleeve 204 to move longitudinally with the axial motion coupling 220. As the deflection sleeve 204 moves towards the downhole end of the rotary steerable tool 128, the deflection ramp 212 engages the shaft ramp 210 causing the steerable shaft 140 to pivot about the pivot bearing 214 and direct the tool string 126 in the new direction.

While illustrative embodiments of this invention have been shown and described, modifications thereof can be made by one skilled in the art without departing from the spirit or teaching of this invention. The embodiments described herein are illustrative and are not limiting. Many variations and modifications of the system and apparatus are possible and are within the scope of the invention. Accordingly, the scope of protection is not limited to the embodiments described herein, but is only limited by the claims which follow, the scope of which shall include all equivalents of the subject matter of the claims.

What is claimed is:

1. A method for steering a tool in a borehole, comprising:

connecting the tool in a drill string capable of drilling a borehole;

computing rotational and axial motion distances to be applied to a deflection sleeve, and controlling rotational and axial motion of the deflection sleeve using a steering control system of rotation resistant housing of the tool;

aligning a deflection ramp of the tool to deflect a steerable shaft of the tool in a predetermined direction by rotating the deflection sleeve of the tool about the steerable shaft;

displacing the deflection sleeve axially along the steerable shaft, engaging the deflection ramp with a shaft ramp of the tool; and angularly deflecting the steerable shaft by the displacing.

2. The method of claim 1, wherein the rotating further comprises:

determining a distance to rotate the deflection sleeve based on a rotational position of the ramp, a reference direction, and a reference location of the rotation resistant housing about the deflection sleeve; and activating a rotation drive motor disposed in the rotation resistant housing.

3. The method of claim 2, wherein the rotating further comprises engaging a pinion gear coupled to the rotation drive motor with a drive gear that is slideably coupled to the deflection sleeve.

4. The method of claim 3, wherein the rotating further comprises transferring rotation from the drive gear to the deflection sleeve via a spline.

5. The method of claim 1, wherein the displacing further comprises:

determining a distance to axially displace the deflection sleeve to cause a predetermined rate of direction change; and activating an axial drive motor disposed in the rotation resistant housing about the deflection sleeve.

6. The method of claim 5, wherein the displacing further comprises converting rotation of the drive motor to linear motion of the deflection sleeve.

7. The method of claim 5, further comprising coupling the drive motor to the deflection sleeve via an extension shaft axial motion coupling disposed in a circumferential groove of the deflection sleeve.

8. The method of claim 1, wherein the deflecting further comprises engaging the deflection ramp with a shaft ramp that is rotatably coupled to the steerable shaft.

9. The method of claim 1, wherein the tool is steered as part of drilling the borehole.

10. A rotary steering tool, comprising:

a steerable shaft;

a deflection sleeve disposed about the shaft; and a rotation resistant housing disposed about the deflection sleeve;

wherein the deflection sleeve determines an angular deflection direction of the steerable shaft by rotating within the housing about the shaft and independent of rotation of both the shaft and the rotation resistant housing; and wherein the steerable shaft, deflection sleeve and rotation resistant housing are connected in a drill string.

11. The rotary steering tool of claim 10, wherein the deflection sleeve deflects the steerable shaft by moving axially along the steerable shaft.

12. The rotary steering tool of claim 10, wherein the deflection sleeve comprises an inclined surface that engages an inclined surface coupled to the steerable shaft, thereby deflecting the steerable shaft by axial movement of the deflection sleeve.

13. The rotary steerable tool of claim 10, wherein the rotation resistant housing further comprises a steering control system that computes rotational and axial motion distances to be applied to the deflection sleeve, and controls rotational and axial motion of the deflection sleeve.

14. The rotary steerable tool of claim 10, further comprising a rotation drive motor disposed in the rotation resistant housing; wherein the deflection sleeve is coupled to the rotation drive motor and the deflection sleeve rotates relative to the rotation resistant housing responsive to rotation of the rotation drive motor.

15. The rotary steerable tool of claim 14, further comprising;

a pinion gear rotatably coupled to the rotation drive motor; and a drive gear rotatably coupled to the pinion gear, and splinedly coupled to the deflection sleeve.

16. The rotary steering tool of claim 10, further comprising an axial drive motor disposed in the rotation resistant housing; wherein the deflection sleeve is coupled to the axial drive motor, and the deflection sleeve moves axially along the steering shaft responsive to rotation of the axial drive motor.

17. The rotary steering tool of claim 16, further comprising one of a ball screw mechanism and a lead screw mechanism that convert the rotation of the axial drive motor to the axial motion of the deflection housing.

18. The rotary steering system of claim 16, wherein the deflection sleeve comprises a circumferential groove that couples the deflection sleeve to an axial motion coupling propelled by the axial drive motor.

19. A steering control system, comprising: a non-transitory computer readable medium encoded with instructions that when executed by a processor cause the processor to:

determine a rotational position of a deflection sleeve within a rotation resistant housing;

rotate the deflection sleeve independent of the rotation of both the rotation resistant housing and a steerable shaft to a rotational position that positions the deflection sleeve to deflect the steerable shaft in a predetermined direction; and deflect the steerable shaft by bi-directionally moving the deflection sleeve axially with respect to the rotation resistant housing.

20. The steering control system of claim 19, wherein the instructions cause the processor to:

determine a distance to rotate the deflection sleeve based on a location of a deflection ramp of the deflection sleeve, a reference direction, and a reference location of the rotation resistant housing; and determine a distance of axial travel of the deflection sleeve based on a predetermined rate at direction change.

21. The steering control system of claim 19, wherein the steering control system is part of a rotary steerable tool.

* * * * *